US009399356B1

(12) United States Patent
Sugimoto

(10) Patent No.: US 9,399,356 B1
(45) Date of Patent: Jul. 26, 2016

(54) PRINTER APPARATUS

(71) Applicant: TOSHIBA TEC KABUSHIKI KAISHA, Shinagawa-ku, Tokyo (JP)

(72) Inventor: Kazuaki Sugimoto, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/859,441

(22) Filed: Sep. 21, 2015

(51) Int. Cl.
*B41J 2/325* (2006.01)

(52) U.S. Cl.
CPC ..... *B41J 2/325* (2013.01)

(58) Field of Classification Search
CPC ..... B41J 31/00; B41J 31/02; B41J 31/04; B41J 31/06; B41J 31/08
See application file for complete search history.

(56) References Cited

U.S. PATENT DOCUMENTS 6,211,895 B1 * 4/2001 Asabe ..... B41J 31/00 347/212
6,384,855 B1 * 5/2002 Miller ..... B41J 11/007 347/215
8,654,164 B2 * 2/2014 Mochizuki ..... B41J 2/0057 347/213

FOREIGN PATENT DOCUMENTS

JP 2003-165265 6/2003
JP 2007-126230 5/2007

* cited by examiner

*Primary Examiner* — Kristal Feggins
(74) *Attorney, Agent, or Firm* — Amin, Turocy & Watson LLP

(57) ABSTRACT

In accordance with one embodiment, a printer apparatus comprises a printing medium supply shaft configured to supply the mounted printing medium; a ribbon supply shaft configured to supply a mounted ink ribbon driven by a driving source; a fixing shaft; a winding driving core configured to be freely rotatably mounted on the fixing shaft to rotate driven by the driving source; and a ribbon winding shaft configured to be freely rotatably mounted on the winding driving core to wind the ink ribbon which is transferred onto and printed on the printing medium using a thermal head, wherein the ribbon winding shaft is configured to transmit the rotation of the driving source through an elastic component arranged between the ribbon winding shaft and the winding driving core.

10 Claims, 5 Drawing Sheets

HUNTING CHARACTERISTIC OF DC MOTOR

PRINTER APPARATUS

FIELD

Embodiments described herein relate to a printer apparatus.

BACKGROUND

Conventionally, in the thermal head printer, a mechanism which conveys the ink ribbon from the ribbon supply shaft on which long ink ribbon is wound through the thermal head to the ribbon winding shaft so as to wind the ink ribbon on the ink ribbon winding shaft is used. In order to maintain a constant winding tension on the ink ribbon, a slip mechanism or a mechanism for varying the torque of the winding motor according to the winding diameter of the ink ribbon wound is used in the ribbon winding shaft.

However, in a case of the slip mechanism, the winding diameter is changed with the winding amount of ribbon, which leads to a change in the tension and a lot of ribbon cannot be wound.

In a case of using a winding motor, as the mechanism for varying the torque of the winding motor according to the diameter of the wound ribbon is used, the tension may be maintained constant even if the winding diameter of ribbon becomes large, and more ribbon can be wound. However, a DC motor is used as a driving source for winding ribbon. The DC motor generates a fluctuation in torque due to the hunting characteristic at the rising time, which may affect the printing. Therefore, in order to provide tension to the ink ribbon in the start of printing, the DC motor is driven before a paper is conveyed.

However, the ink ribbon does not move because it is synchronized with the recording medium, and a load is generated in the DC motor, which is the tension. If the paper is conveyed and the ink ribbon moves, the motor load is suddenly reduced and the tension is reduced instantly. When the paper conveyance speed is high, there is a case in which the follow ability of the DC motor falls, loosening occurs in the ink ribbon. In this case, a printing failure such as a printing omission and the like occurs. Further, after a DC motor followed, a load is generated in the DC motor and the tension is increased, therefore a fluctuation in torque due to the hunting characteristic occurs. Hunting characteristic is attenuated if the constant current (load) is applied to the DC motor, but the hunting generated in the start of printing heavily affects the printing.

DETAILED DESCRIPTION

In accordance with one embodiment, a printer apparatus comprises a printing medium supply shaft configured to supply the mounted printing medium; an ink ribbon supply shaft configured to supply a mounted ink ribbon driven by a driving source; a fixing shaft; a winding driving core configured to be freely rotatably mounted on the fixing shaft to rotate driven by the driving source; and a ribbon winding shaft configured to be freely rotatably mounted on the winding driving core to wind the ribbon which is transferred onto and printed on the printing medium using a thermal head, wherein the ribbon winding shaft is configured to transmit the rotation of the driving source through an elastic component arranged between the ribbon winding shaft and the winding driving core.

Hereinafter, embodiments are described in detail with reference to the accompanying drawings.

Figure 1:
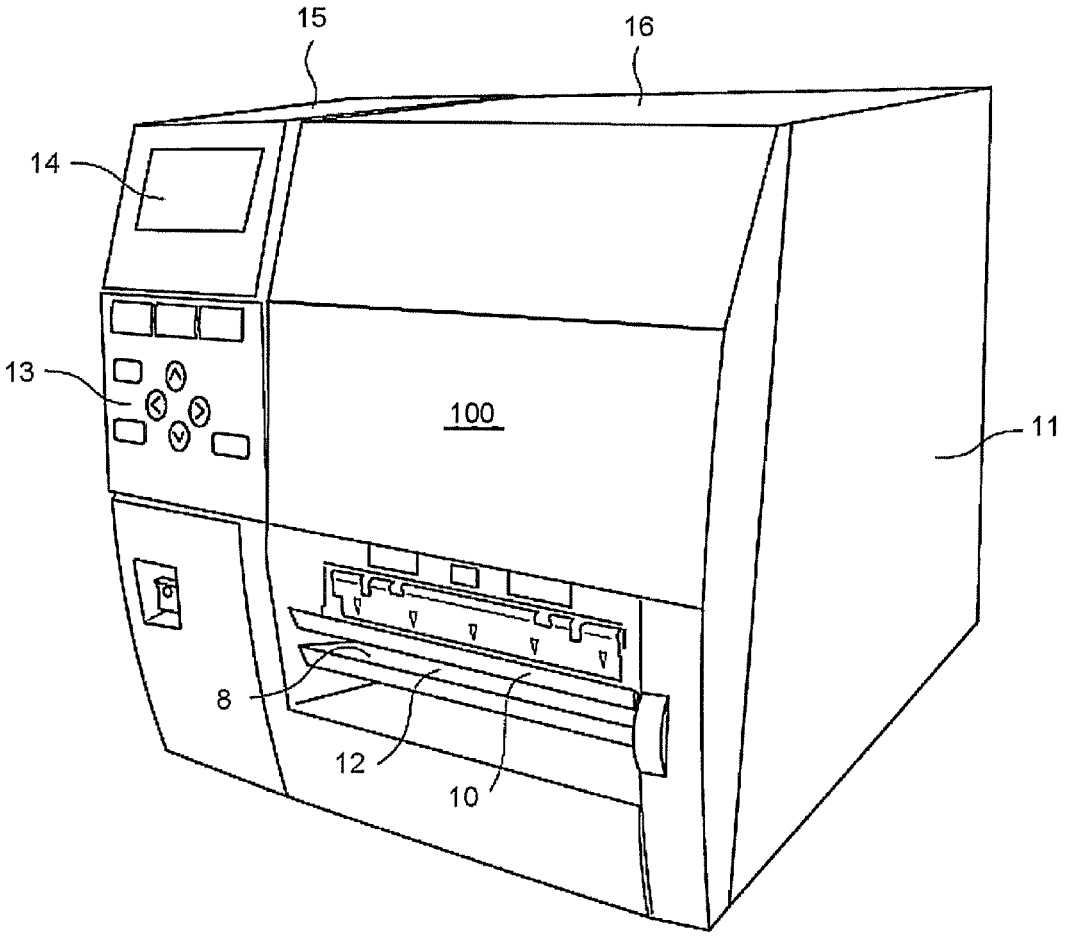
FIG. 1 is a perspective view schematically illustrating a printer apparatus according to an embodiment.
Figure 2:
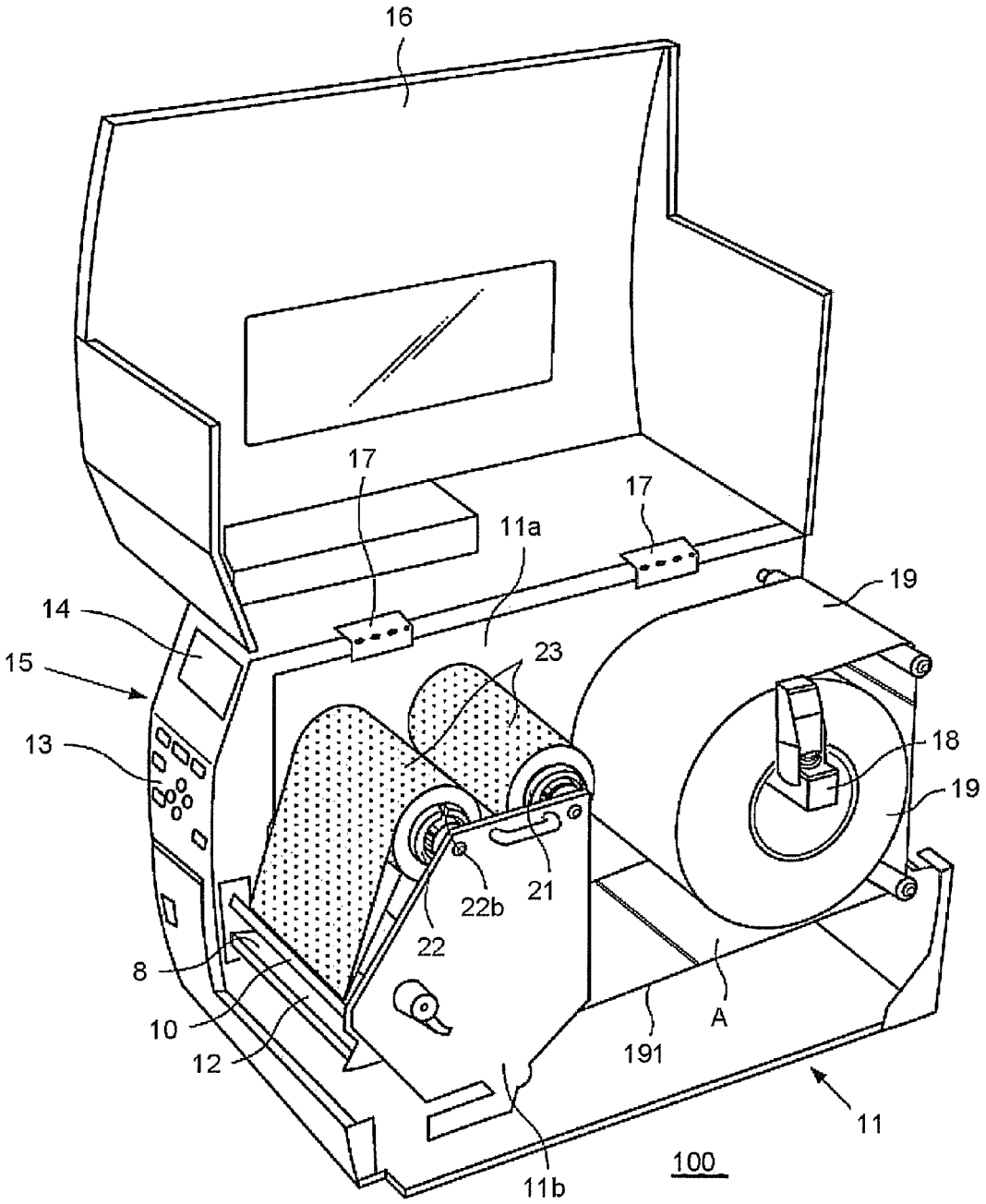
FIG. 2 is a perspective view illustrating the printer apparatus in FIG. 1 in a state where the cover thereof is opened.
Figure 3:
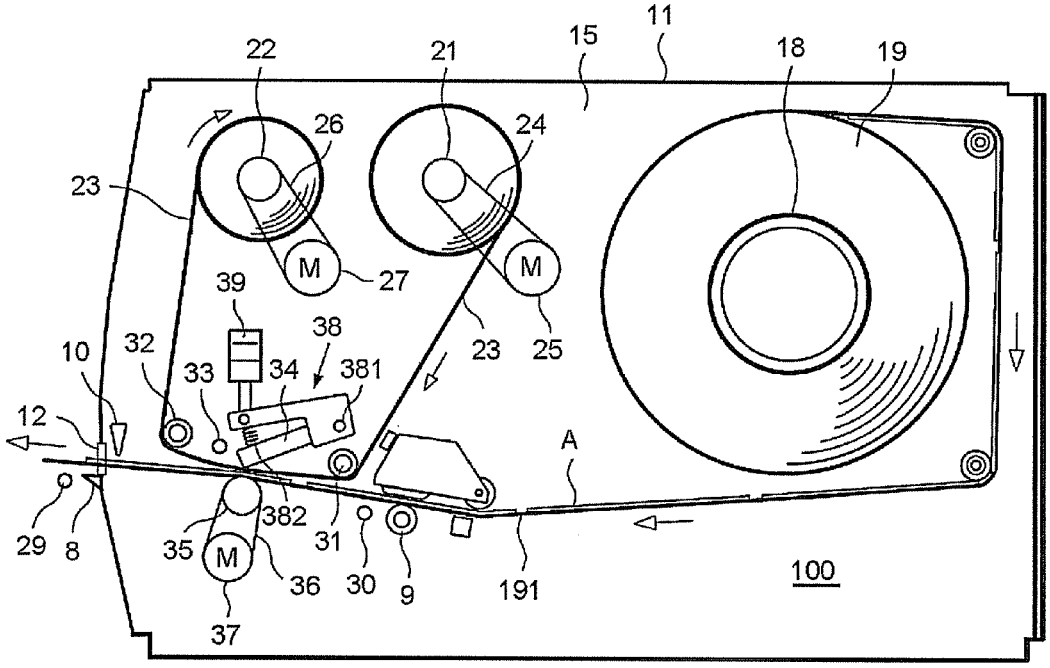
FIG. 3 is a longitudinal section view schematically illustrating an internal structure of the printer apparatus.

FIG. 1 is a perspective view schematically illustrating the appearance of the printer apparatus according to an embodiment. FIG. 2 is a perspective view schematically illustrating the printer apparatus in a state where the cover thereof is opened. FIG. 3 is a longitudinal section view schematically illustrating an internal structure of the printer apparatus.

The present embodiment exemplifies a thermal printer 100 as the printer apparatus. A printing medium of the thermal printer 100 is assumed to be a label temporarily attached to a roll-type mount. The printing medium, which is not limited to the label, may also be a tag or a sheet and the like.

As shown in FIG. 1, a discharge port 12 through which a printed label is discharged is formed in the front of a main body housing 11 of the printer 100. A cutter 10 is arranged at the upper and lower portions of the discharge port 12 inside the main body housing 11. A peeling table 8 is arranged nearby a position opposite to the cutter 10. A control box 15, which comprises an input section 13 consisting of various operation keys, and a display device 14 and the like in the front thereof, is arranged at the left side of the main body housing 11. A control section driving and controlling each section of the printer 100 is arranged inside the control box 15.

As shown in FIG. 2, a cover 16 for covering the inside of the main body housing 11 is arranged above the main body housing 11. The cover 16 is arranged to be rotatable upwards by taking a hinge 17, which is arranged at the upper portion of the main body housing 11 at the side of the control box 15, as a center.

As shown in FIG. 3, a label roll 19 serving as a printing medium supplying unit for supplying a printing medium wound in a roll shape is supported to be rotatable by a label supply shaft 18 inside the main body housing 11 of the printer 100. The label roll 19 is constituted by temporarily attaching a label A to a mount 191 in a peelable manner.

Further, an ink ribbon 23 is mounted on a ribbon supply shaft 21 and a ribbon winding shaft 22. The ribbon supply shaft 21 is driven by a DC motor 25 through a timing belt 24. The ribbon winding shaft 22 is driven by a DC motor 27 through a timing belt 26. The DC motor 27 drives the ribbon winding shaft 22, thereby winding the ink ribbon 23 conveyed forward.

Further, the DC motor 25 drives the ribbon supply shaft 21, thereby rewinding the ink ribbon 23 backward. In addition, the 'forward' mentioned herein refers to a direction in which the label roll 19 is conveyed by a platen roller 35, that is, a direction from an upstream side (right side of the figure) in a conveyance direction to a downstream side (left side of the figure) in the conveyance direction.

A label sensor 30 is arranged nearby a guide pole 31. The label sensor 30 detects the border of the label A attached to the mount 191, and supplies the detection result to a control section 40 which controls the conveyance of the label roll 19 and will be described later. A reflection type or transmission type line sensor formed by combining a light-emitting element such as a LED and the like and a light-receiving element such as a phototransistor and the like may be used as the label sensor 30.

Moreover, a peeling sensor 29 is arranged nearby the discharge port 12. The peeling sensor 29 monitors whether the label A is still attached to or peeled from the pasting part of the mount 191 after the label and the mount are separated (peeled) after the printing operation. The detection result of the peeling sensor 29 is supplied to the control section 40. The peeling sensor 29 may be a reflection type or transmission type line sensor formed by combining a light-emitting element such as a LED and the like and a light-receiving element such as a phototransistor and the like. The peeling sensor 29 detects that the label A is still attached to the mount 191 if the transmittance of light is zero or low. Further, the peeling sensor 29 detects that the label A is peeled from the mount 191 if the transmittance of light is high.

Guide poles 31 and 32 are arranged to specify the conveyance route of the ink ribbon 23. Further, a ribbon monitoring sensor 33 is arranged in the conveyance route of the ink ribbon 23 to detect the used part of the ink ribbon 23. The ribbon monitoring sensor 33 may be a reflection type or transmission type line sensor formed by combining a light-emitting element such as a LED and the like and a light-receiving element such as a phototransistor and the like. The ribbon monitoring sensor 33 can detect the whole area in a width direction of the ink ribbon 23. The ribbon monitoring sensor 33 can distinguish the used part and the unused part of the ink ribbon 23 by sensing the light reflectance or light transmittance of the ink ribbon 23. The ribbon monitoring sensor 33 is arranged at a position more downstream than a thermal head 34 in a conveyance direction of the label roll 19.

Herein, the label supply shaft 18 is equivalent to a label supply unit for supplying the label A. The ribbon supply shaft 21, the ribbon winding shaft 22, the timing belts 24 and 26, the DC motor 25 and the DC motor 27 are equivalent to an ink ribbon supply unit for supplying the ink ribbon 23. Further, a pinch roller 9, the platen roller 35, the belt 36 and a stepping motor 37 serving as a line feed motor are equivalent to a conveyance unit for conveying the label roll 19.

The thermal head 34 has a collection of fine heating elements for generating heat by flow a current, and is arranged opposite to the platen roller 35 across the label roll 19 and the ink ribbon 23. These heating elements are enabled to generate heat by applying voltage to the heating elements to flow the current, and the ink of the ink ribbon 23 is transferred onto the label A, thereby the printing operation is carried out.

A head pressing mechanism 38 is supported by a support shaft 381 in a rotatable manner. The thermal head 34 is also supported by the support shaft 381 in a rotatable manner. A spring 382 is installed between the head pressing mechanism 38 and the thermal head 34 at a distance from the support shaft 381. The head pressing mechanism 38 is constituted in such a manner that the thermal head 34 is raised against a spring force of the spring 382 with a movable portion of the solenoid 39. The solenoid 39 contacts the thermal head 34 with the ink ribbon 23 when the movable portion is stretched, and separates the thermal head 34 from the ink ribbon 23 when the movable portion is pulled up.

The head pressing mechanism 38 described herein is a constitution for raising and lowering the thermal head 34 using the solenoid 39 and the spring 382. The head pressing mechanism 38 may also be, for example, a head pressing mechanism for separating the thermal head from the platen roller using an electric actuator shown in Japanese Unexamined Patent Application Publication No. 2012-51204.

The guide poles 31 and 32 and the ribbon monitoring sensor 33 may be driven upwards and downwards interlocking with the upward and downward rotation of the thermal head 34 by the head pressing mechanism 38 or other mechanism, or be fixed at a specific position in the main body housing 11.

In a case of carrying out printing on the label A, the thermal head 34 is pressed against the platen roller 35 in a state where the label roll 19 and the ink ribbon 23 are between the thermal head 34 and the platen roller 35. Then, the stepping motor 37 is driven to rotate the platen roller 35 through the belt 36. The label roll 19 and the ink ribbon 23 are conveyed intermittently from the upstream side to the downstream side of the conveyance direction.

The conveyance of the label roll 19 and the ink ribbon 23 is controlled based on the detection result of the label sensor 30. At this time, the DC motor 27 drives the ribbon winding shaft 22 to wind the ink ribbon 23.

In this way, a printing signal is supplied to the thermal head 34 while the label roll 19 and the ink ribbon 23 are being intermittently conveyed, and the heating elements of the thermal head 34 generate heat, thereby the printing is carried out on the label A. The printed label A is discharged to the outside from the discharge port 12. The discharged label A becomes individual labels A by cutting the mount 191 with the cutter 10, and the individual label A is separated from the mount 191 to which the label A is temporarily attached.

Figure 4:
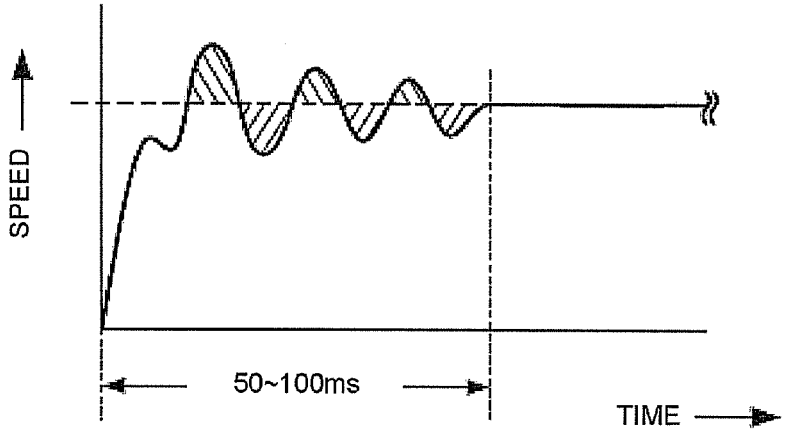
FIG. 4 is a diagram illustrating the hunting of a DC motor.

However, the DC motor 25 serving as the driving source, which rotates the ribbon supply shaft 21 to wind the ink ribbon 23, generates a fluctuation in torque called hunting. As shown in FIG. 4, a hunting phenomenon occurs for about 50 ms-100 ms when the DC motor is started.

The ink ribbon 23 is output in synchronization with the label roll 19 through the thermal head 34 and the platen roller 35 to be rolled on the ribbon winding shaft 22. If the current is applied to the motor when the discharge amount and the winding amount of the ink ribbon 23 are the same, ribbon tension becomes 0, and an amount corresponding to the increase in the current applied is the ribbon tension. However, it takes time to make the rotation of the DC motor 27 constant. Thus, in the start of printing, it is necessary to add the current to speed up the rotation rather than the required rotation speed. In addition, since the rotation speed of the motor does not change linearly even a current value lowers, a hunting phenomenon occurs until the tension becomes constant. Variation of the tension leads to the wrinkles on the ink ribbon 23. In a case where the ink ribbon 23 is wound on the ribbon winding shaft 22 in a state where wrinkles generated, variations in tension in the transverse direction of the ink ribbon 23 is generated, which furthers the occurrence of wrinkles even more. That is, wrinkles are generated due to compression (buckling) in the width direction if the ink ribbon 23 is pulled in the longitudinal direction of the ink ribbon 23.

Thus, the ribbon winding shaft 22 which suppresses the influence on the printing due to the hunting of the DC motor in the start of printing is described with reference to FIG. 5 and FIG. 6.

Figure 5:
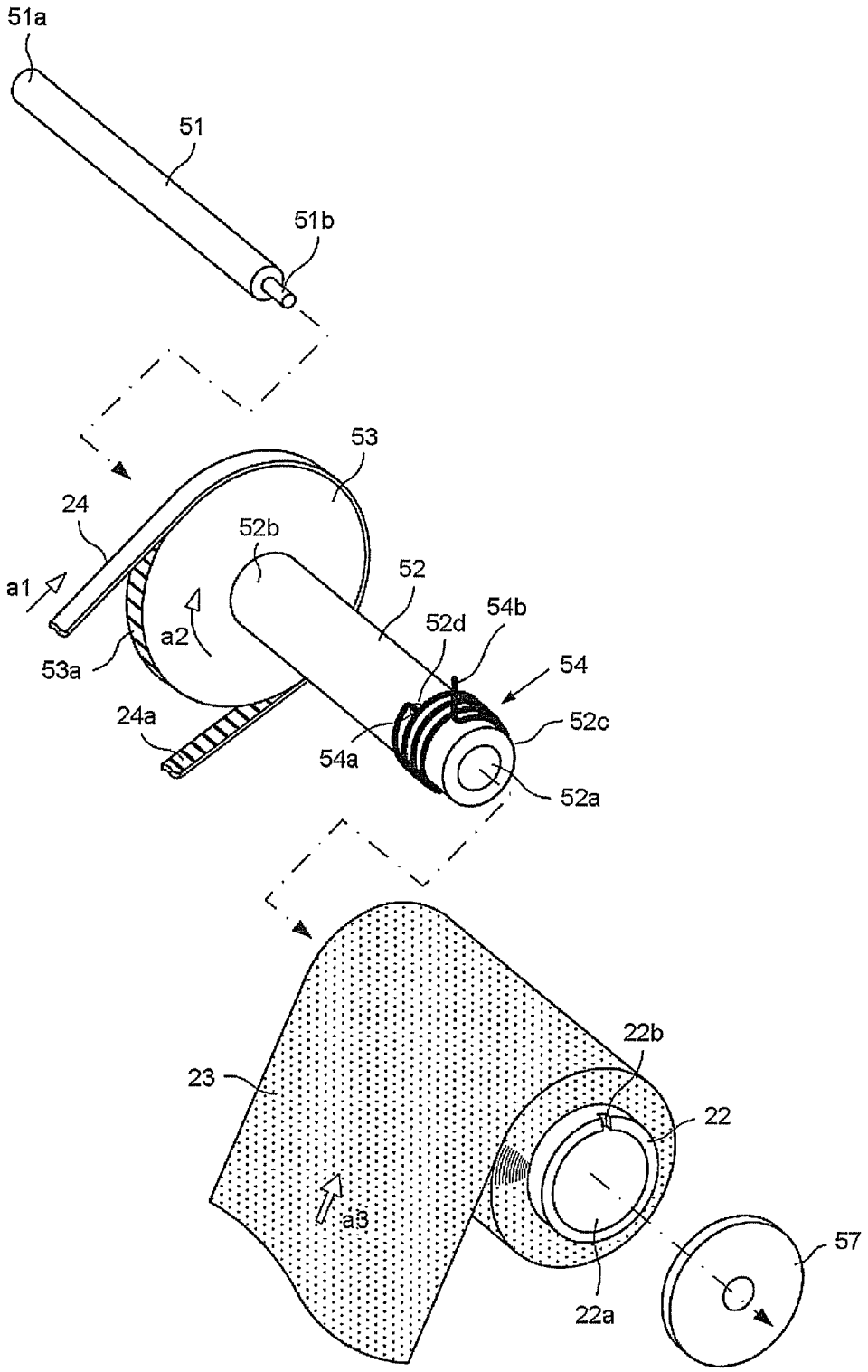
FIG. 5 is an exploded perspective view illustrating a main part in FIG. 2.

FIG. 5 illustrates an exploded perspective view of a main part of FIG. 2 taking the ribbon winding shaft 22 as a center. FIG. 6 illustrates a cross-sectional view of a main part of FIG. 2 taking the ribbon winding shaft 22 as a center.

In FIG. 5, 51 is a fixing shaft for rotatably supporting a winding driving core 52 to pass through a through hole 52*a* of the cylindrical winding driving core 52 which is used for winding the ink ribbon 23. One end 51*a* of the fixing shaft 51 is attached to, for example the frame 11*a* of the metal frame 11*a* and the frame 11*b* which are configured opposite to each other in the main body housing 11, and the other end 51*b* is attached to the frame 11*b* (refer to FIG. 2). In addition, to insert and attach to the frame 11*b*, the other end 51*b* is formed in a small diameter.

At one end 52*b* of the winding driving core 52, a disc-shaped driving gear 53 driven integrally with the winding driving core 52 is formed integrally. A gear 53*a* is formed on the outer periphery of the driving gear 53. The gear 53*a* is engaged with a gear 24*a* on the inner peripheral side of the timing belt 24. In addition, the gear 24*a* of the timing belt 24 is engaged with a gear pulley 27*a* which is attached to the rotating shaft of the DC motor 27. The driving gear 53 can be rotated through the timing belt 24 driven by the DC motor 27.

A torsion spring 54 serving as an elastic component is locked to near the outer periphery of the other end 52*c* of the winding driving core 52. One end 54*a* of the torsion spring 54 is locked to a locking hole 52*d* formed in the winding driving core 52.

The cylindrical ribbon winding shaft 22 a through hole 22*a* on which is formed is inserted into the winding drive core 52. The ribbon winding shaft 22 is rotatably supported by the winding driving core 52 as a shaft. A cutout section 22*b* is formed on the open end on the opposite side of the gear 53*a* of the ribbon winding shaft 22. After the ribbon winding shaft 22 is inserted into the winding driving core 52, the other end 54*b* of the torsion spring 54 is locked to the cutout section 22*b*.

Figure 6:
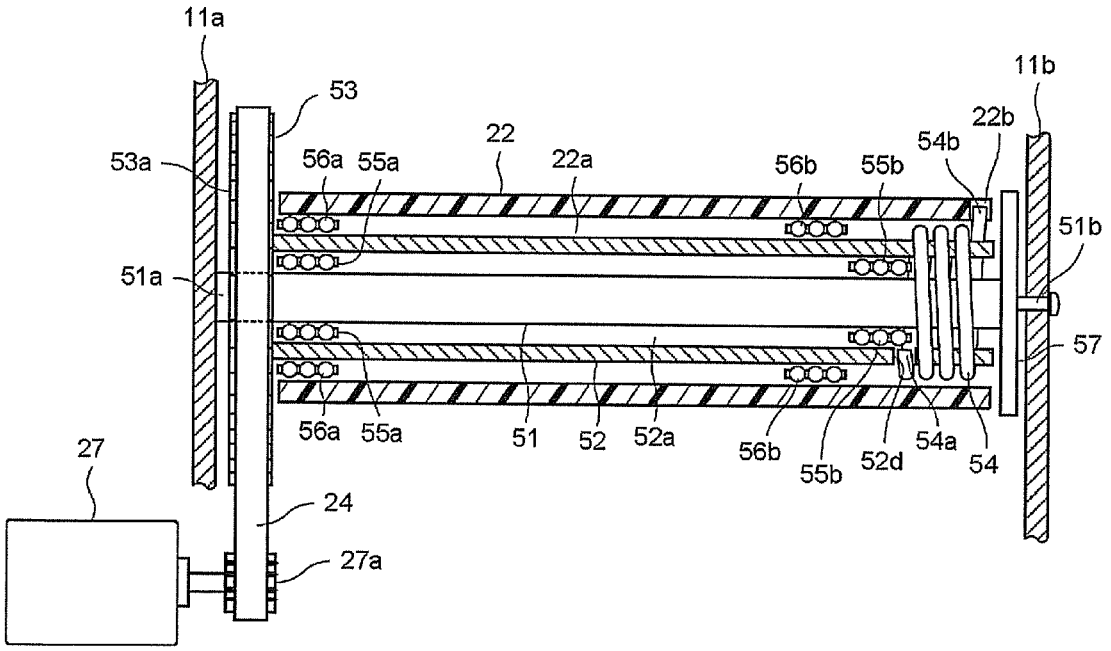
FIG. 6 is a cross-sectional view illustrating a main part in FIG. 2.

Further, as shown in FIG. 6, the bearings 55*a*, 55*b* are arranged at predetermined intervals between the outer periphery of the fixing shaft 51 and the inner periphery of the through hole 52*a* of the winding driving core 52. Further, the bearings 56*a*, 56*b* are arranged at predetermined intervals between the outer periphery of the winding driving core 52 and the inner periphery of the through hole 22*a* of the ribbon winding shaft 22. The bearings 55*a*, 55*b* enable the winding driving core 52 to rotate smoothly. The bearings 56*a*, 56*b* enable the ribbon winding shaft 22 to rotate smoothly.

57 is a guide member. The guide member 57 is attached to the fixing shaft 51 and the frame 11*b*. The guide member 57 serves as a guide which is used not to make the winding driving core 52 and the ribbon winding shaft 22 come off.

Herein, the function of the torsion spring 54 is described.

When the DC motor 27 is driven, the timing belt 24 travels in a direction indicated by an arrow a1 serving as a forward direction shown in FIG. 5. The gear 24*a* of the timing belt 24 is engaged with the gear 53*a* of the driving gear 53. Thus, the driving gear 53 rotates in a direction indicated by an arrow a2. With this rotation, the winding driving core 52 is also rotated.

With the rotation of the winding driving core 52, the one end 54*a* of the torsion spring 54 is to be pulled. Under this tensile force, the ribbon winding shaft 22 locked with the other end 54*b* of the torsion spring 54 begins to rotate taking the winding driving core 52 as a center, and the ink ribbon 23 mounted on the winding driving core 52 is made to travel in a direction indicated by an arrow a3 to be wound around the ribbon winding shaft 22.

In other words, during the initial rotation driven by the DC motor 27, the rotation of the winding driving core 52 acts as a buffer of the torsion spring 54.

Meanwhile, a control section of the printer 100 controls to wind the ribbon to generate a tension before the printing is started. If the control section conveys the label roll 19 and the ink ribbon 23 is traveled, the motor load is reduced rapidly, due to the hunting characteristic in the rising of the DC motor 27. This reduction time becomes a rotation delay of the DC motor 27, and the tension of the ink ribbon 23 would be lowered.

However, the ribbon winding shaft 22 rotates in a state of being pulled by the torsion spring 54. First, the reduction in torque of the DC motor 27 due to the hunting characteristic shown by the hunting on the lower left in FIG. 4 is described. If the rotation delay in the DC motor 27 is generated, the winding force of the torsion spring 54 is applied to the ribbon winding shaft 22. Thus, it is possible to reduce the variation of the tension during the traveling of the ink ribbon 23 by the winding force of the torsion spring 54.

Then, the increase in the torque of the DC motor 27 due to the hunting characteristic shown by the hunting on the lower right edge in FIG. 4 is described. If the torque of the DC motor 27 is increased, it is possible to suppress the fluctuation in tension applied to the ink ribbon 23 by the action of the torsion spring 54.

Thus, if it is a direct current type motor drive for winding the ink ribbon 23, the fluctuation in torque due to the hunting characteristic of the DC motor 27 at the rising time of the DC motor 27 occurs. If the torque of the DC motor 27 is increased, the change in the angle of the torsion spring 54 is increased. This ensures that when torque is high, the shock to the ink ribbon 23 in the torsion spring 54 can be reduced. On the contrary, if the ink ribbon 23 becomes loose as the torque of the DC motor 27 is lowered, it is possible to prevent loosening due to the force of the torsion spring 54. In this way, the torsion spring 54 can reduce the influence on printing due to the hunting characteristic.

In the embodiment, a torsion spring is interposed between the driving source side by the DC motor and the ribbon winding side (such as the side of the ribbon winding shaft and the like) by the DC motor to transmit the rotation of the DC motor to the ribbon winding shaft. In this way, it is possible to suppress the fluctuation in tension of the ink ribbon due to the hunting characteristic occurring at the rising of the DC motor so as to realize a good printing.

In the embodiment described above, a spring is exemplified with a torsion spring, but is not limited to this material. For example, it may be an elongated plate-like spring, like a power spring, which is arranged to be wound around the winding driving core 52 in plural turns, one end of which is locked in the winding driving core 52 and the other end of which is locked in the ribbon winding shaft 22. It may be also a coil spring which is arranged around the outer periphery of the winding driving core 52, one end of which is locked in the winding driving core 52 and the other end of which is locked in the ribbon winding shaft 22. By using other materials different from the torsion spring against the hunting phenomenon, the effect the same as that obtained by using the torsion spring can be obtained.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus, comprising:

a printing medium supply shaft configured to supply the mounted printing medium;

a ribbon supply shaft configured to supply an mounted ink ribbon driven by a driving source;

a fixing shaft;

a winding driving core configured to be freely rotatably mounted on the fixing shaft to rotate driven by the driving source; and a ribbon winding shaft configured to be freely rotatably mounted on the winding driving core to wind the ink ribbon which is transferred onto and printed on the printing medium using a thermal head, wherein the ribbon winding shaft is configured to transmit the rotation of the driving source through an elastic component arranged between the ribbon winding shaft and the winding driving core.

2. The printer apparatus according to claim 1, wherein the driving source for driving the winding driving core is a DC motor.

3. The printer apparatus according to claim 2, wherein the elastic component suppresses the fluctuation in torque due to the hunting characteristic of a DC motor at the rising time of the DC motor.

4. The printer apparatus according to claim 1, wherein the driving source for driving the winding driving core is connected with a gear pulley attached to a rotation shaft of the driving source and a disc-shaped driving gear integrally formed with the winding driving core through a timing belt.

5. The printer apparatus according to claim 1, wherein the elastic component is a torsion spring.

6. The printer apparatus according to claim 5, wherein the torsion spring is arranged in the winding driving core, one end of which is locked in the winding driving core and the other end of which is locked in the ribbon winding shaft.

7. The printer apparatus according to claim 1, wherein the elastic component is a power spring.

8. The printer apparatus according to claim 1, wherein the elastic component is a coil spring which is configured along the outer periphery of the winding driving core, one end of which is locked in the winding driving core and the other end of which is locked in the ribbon winding shaft.

9. The printer apparatus according to claim 1, wherein the ribbon supply shaft is driven by a DC motor.

10. The printer apparatus according to claim 1, wherein the printing medium supplied from the printing medium supply shaft is conveyed by a stepping motor.

* * * * *